US010506323B2

(12) United States Patent
Pi et al.

(10) Patent No.: US 10,506,323 B2
(45) Date of Patent: Dec. 10, 2019

(54) USER CUSTOMIZABLE HEADPHONE SYSTEM

(71) Applicant: Shenzhen Goodix Technology Co., Ltd., Shenzhen (CN)

(72) Inventors: Bo Pi, San Diego, CA (US); Yi He, San Diego, CA (US)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/024,093

(22) Filed: Jun. 29, 2018

(65) Prior Publication Data

US 2019/0007765 A1 Jan. 3, 2019

Related U.S. Application Data

(60) Provisional application No. 62/526,998, filed on Jun. 29, 2017.

(51) Int. Cl.
*H04R 5/00* (2006.01)
*H04R 1/10* (2006.01)
(Continued)

(52) U.S. Cl.
CPC ..... *H04R 1/1041* (2013.01); *H04R 5/033* (2013.01); *H04R 5/04* (2013.01); *H04R 1/1083* (2013.01);
(Continued)

(58) Field of Classification Search
CPC ..... H04R 1/1041; H04R 3/04; H04R 5/033; H04R 5/04
See application file for complete search history.

(56) References Cited

U.S. PATENT DOCUMENTS

2003/0223602 A1* 12/2003 Eichler ..... H04S 3/004 381/309
2010/0085948 A1* 4/2010 Yu ..... H04L 12/66 370/338
(Continued)

FOREIGN PATENT DOCUMENTS

CN 102118670 A 7/2011
CN 102970634 A 3/2013
(Continued)

OTHER PUBLICATIONS

Chinese Application No. 201880001085.1 Office Action dated Jul. 2, 2019, (9 pages).
(Continued)

*Primary Examiner* — Simon King
(74) *Attorney, Agent, or Firm* — Perkins Coie LLP

(57) ABSTRACT

An apparatus may include a first headphone. The first headphone may include a first audio transducer and a second audio transducer. The first audio transducer may generate sound according to a first spectral mask and the second audio transducer may generate sound according to a second spectral mask. The first spectral mask and the second spectral mask may be adjustable at the first headphone. The first headphone may include a digital interface. The apparatus may further include a headphone controller to control the first headphone. The headphone controller may receive an audio signal from a portable electronic device and/or the headphone controller may transmit digital information representing speech, sound, or music to the first headphone. In response to a user input, the headphone controller may cause an adjustment to one or more of the first spectral mask or the second spectral mask.

16 Claims, 5 Drawing Sheets

(51) Int. Cl.

| | |
|---|---|
| ***H04R 5/033*** | (2006.01) |
| ***H04R 5/04*** | (2006.01) |
| *H04R 3/04* | (2006.01) |
| *H04S 5/00* | (2006.01) |

(52) U.S. Cl.
CPC ..... *H04R 3/04* (2013.01); *H04R 2201/107* (2013.01); *H04R 2420/07* (2013.01); *H04R 2420/09* (2013.01); *H04R 2460/07* (2013.01); *H04S 5/00* (2013.01)

(56) References Cited

U.S. PATENT DOCUMENTS

| | | | | |
|---|---|---|---|---|
| 2011/0158440 | A1* | 6/2011 | Mei ..... | H04R 1/1016 381/309 |
| 2015/0092968 | A1* | 4/2015 | Grinker ..... | H04R 1/1016 381/322 |
| 2015/0281829 | A1 | 10/2015 | Gauger et al. | |
| 2015/0350786 | A1 | 12/2015 | Capp et al. | |

FOREIGN PATENT DOCUMENTS

| | | | |
|---|---|---|---|
| CN | 102970637 | A | 3/2013 |
| CN | 106062746 | A | 10/2016 |
| CN | 106303779 | A | 1/2017 |

OTHER PUBLICATIONS

Partial Supplementary Search Report for European Application No. 188231674, dated Oct. 14, 2019 (18 pages).

* cited by examiner

USER CUSTOMIZABLE HEADPHONE SYSTEM

CROSS REFERENCE TO RELATED APPLICATIONS

This patent document claims the benefit of priority of U.S. Provisional Patent Application No. 62/526,998, filed on Jun. 29, 2017. The entire content of the before-mentioned patent application is incorporated by reference as part of the disclosure of this document.

TECHNICAL FIELD

The present disclosure relates to digital headphones.

BACKGROUND

Portable headphones are an essential part of various modern electronic devices including portable devices such as wearable devices, smartphones, tablets or laptops. Headphones enable a user to listen to music, audio media, video media, radio, lectures, podcasts, or various other audio recordings or conduct telephone calls, video calls, or other live communications. Headphones vary from large over-the-ear devices to small in-the-ear devices. Headphones can also be used to interface with a player enabling a user to perform certain operations on a connected device from control buttons on the headphones, e.g., selecting audio tracks or segments, songs, podcast, or other audio content, controlling audio playing operations such as skipping one or one audio tracks to a desired audio track or pausing the playing of a particular track.

SUMMARY

The disclosed technology can be used to generate sound in headphones and manage how a user interacts with and operates the headphones based on the user's personal preferences to improve the customized delivery of sound and user interface operations. The headphones based on the disclosed technology can be implemented to generate high-quality audio using multiple transducers where each transducer operates in a different frequency band. The headphones may be in communication with a host device or a headphone controller for playing audio material via a cable or wireless link. The disclosed technology can be used to enable low-cost and high-quality customized audio generation.

In one aspect, a method is provided for generating sound to include receiving, at a headphone, an audio signal that includes speech, sound, or music and receiving one or more commands from a separate user electronic device, wherein the headphone includes at least one audio transducer to produce adjustable sound characteristics at the headphone; receiving, via a digital interface at the headphone, a user command that specifies a desired sound reproduction profile specified by a user; and adjusting, in response to the received user command, an operation of the at least one audio transducer to adjust sound characteristics at the headphone based on the desired sound reproduction profile specified by the user.

In another aspect, there is an apparatus including a first digital headphone. The first digital headphone may include a first audio transducer and a second audio transducer. The first audio transducer may generate sound according to a first spectral mask and the second audio transducer may generate sound according to a second spectral mask. The first spectral mask and the second spectral mask may be adjustable at the first digital headphone. The first digital headphone may include a digital interface. The apparatus may further include a headphone controller to control the first digital headphone. The headphone controller may receive an audio signal from a portable electronic device and/or the headphone controller may transmit digital information representing speech, sound, or music to the first digital headphone. In response to a user input, the headphone controller may cause an adjustment to one or more of the first spectral mask or the second spectral mask.

The following features may be included in implementing the above headphone apparatus. The first digital headphone may further include a third audio transducer, wherein the third audio transducer generates sound according to a third spectral mask. The first spectral mask may correspond to bass frequencies, the second spectral mask corresponds to mid-range frequencies, and the third spectral mask corresponds to high frequencies. The apparatus may include a second digital headphone including between one and three additional audio transducers, wherein each of the additional audio transducers has a different corresponding spectral mask, wherein the second digital headphone includes a digital interface to receive digitized audio and commands from the headphone controller. The second digital headphone may receive a second digital information representing speech sound, or music. The audio signal may be represented by a parallel digital data stream or a serial digital data stream. The audio signal may be an analog voltage signal. The portable electronic device may include a smartphone, cell phone, iPhone, iPod, iPod Touch, or other electronic device. One or more of the first spectral mask and the second spectral mask may be adjusted to cause a three-dimensional sound effect. One or more timing delays may be added to the digital information to generate the three-dimensional sound effect. The headphone may include one or more interfaces to receive information from one or more of an accelerometer, a microphone, a gyroscope, a biological sensor, a head position sensor, a heart rate sensor, or other sensor.

The above and other aspects of the disclosed technology are described in greater detail in the drawings, the description and the claims.

BRIEF DESCRIPTION OF THE DRAWINGS

Where possible, like reference numbers refer to the same or similar features in the drawings.

DETAILED DESCRIPTION

A digital headphone system is disclosed that can be interfaced to portable or fixed electronic equipment such as a smartphone or any other electronic equipment with an analog or digital interface. A digital headphone system based on the disclosed technology may include one or more headphones and a headphone controller. Each headphone may include an analog and/or digital interface to the headphone controller. The headphone controller may include the same or a different analog and/or digital interface to the electronic equipment.

For example, a headphone system for implementing the disclosed technology may include two headphones and a headphone controller. Each headphone may connect to the headphone controller via a suitable digital communication interface such as a serial interface, a parallel interface, or a combination serial-parallel interface. The headphone controller may connect to electronic equipment such as a smartphone, a tablet, or some other digital computing or communicating device via a digital interface such as a serial, parallel, or serial-parallel interface.

A headphone for implementing the disclosed technology may include one or more audio transducers that produce audio sound. For example, a headphone may include three transducers. The transducers may operate in different audio or acoustic frequency ranges, e.g., 20 Hz to 20 KHz. For example, in a 3-transducer headphone system, one transducer may produce bass or sub-bass frequencies at the low frequency end of the audio spectrum, another transducer may produce midrange frequencies, and yet another transducer may produce high frequencies. In some implementations, a single transducer may be designed to produce audio in different acoustic frequency ranges.

The digital interface between each headphone and the headphone controller may carry data from the headphone controller to each headphone including digitized audio data and may include command information for each headphone.

Figure 1:
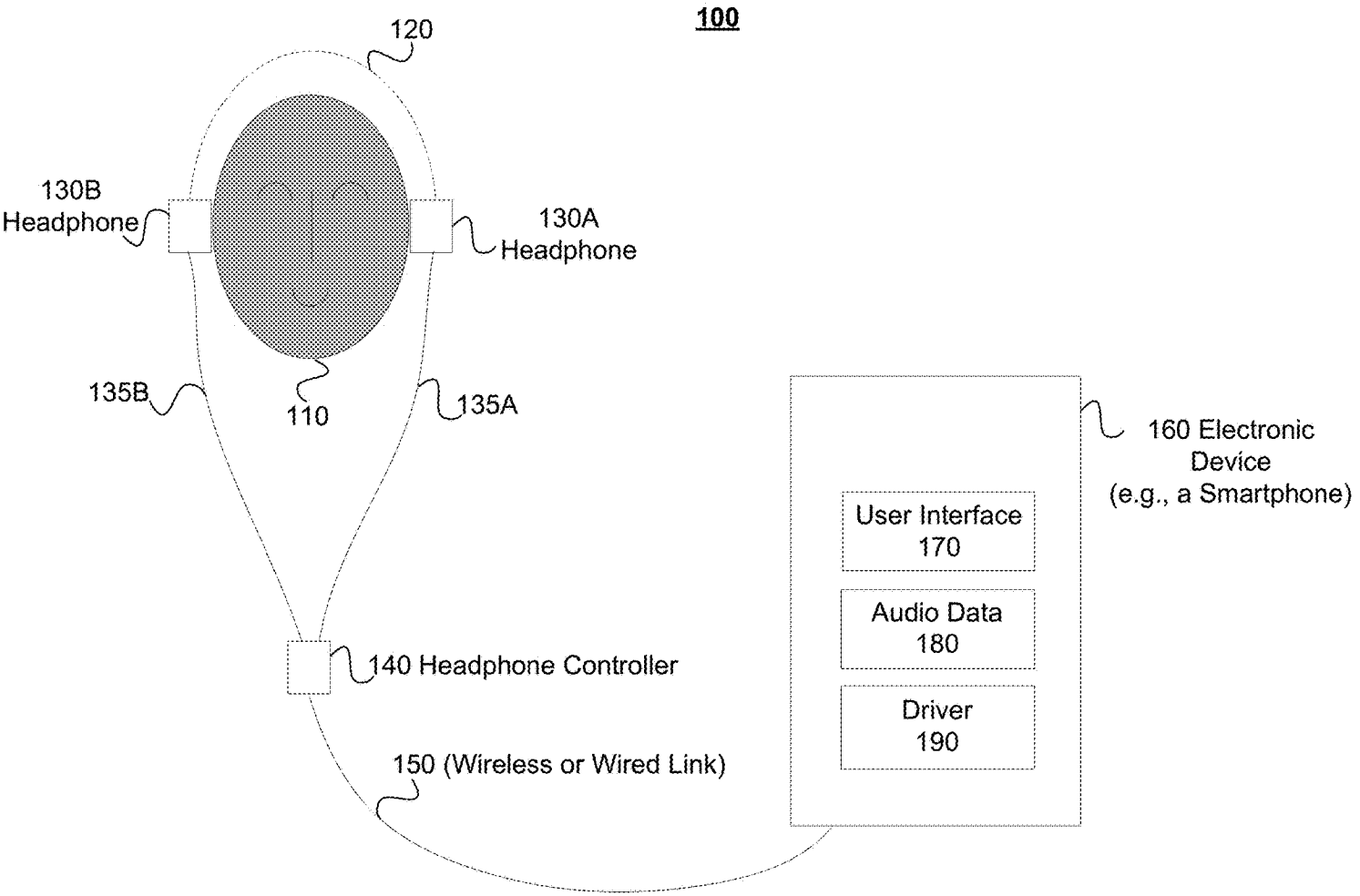
FIG. 1 depicts an example of a headphone system for implementing the disclosed technology.

FIG. 1 depicts an example of a headphone system for implementing the disclosed technology. A user's head 110 is shown wearing the headphone system with headphone 130A for the user's left ear and headphone 130B for the user's right ear. Headphones 130A and 130B connect via wired or wireless interfaces 135A and 135B to a headphone controller 140 (wired interface shown). Headphone controller 140 may connect via wired or wireless interface 150 to electronic equipment 160 which sends audio signals to the headphone controller 140 via the interface 150. In some implementations, the two headphones 130A and 130B may be separated from each other as two physically separated parts, and in other implementations, may be physically connected to each other by a connection 120.

A headphone, such as headphone 130A or 130B, may include one or more audio transducers. For example, headphone 130A may include one, two, three or more transducers. In some implementations, each transducer may generate sound in a designated audio frequency range and different transducers may be designed to produce sounds in different designated audio frequency ranges to collectively produce a desired audio reproduction for listening by the user. The different frequency ranges may overlap. For example one transducer may produce bass frequencies, one transducer may produce midrange frequencies, and another transducer may produce high frequencies. Each headphone may include a microprocessor and/or digital signal processor to provide filtering and/or amplitude adjustment to the digital audio received from the headphone controller. In some others designs, a transducer may generate sound in two or more different designated audio frequency ranges.

The interface 150 between each headphone 130A/130B and the headphone controller 140 may carry data from the headphone controller 140 to each headphone 130A/130B including digitized audio data and may include command data for each headphone. In some example embodiments, interfaces 135A and 135B may include cables that connect headphones 130A and 130B to headphone controller 140. Interfaces 135A and 135B that are cables may carry the digitized audio and commands in a serial and/or parallel bit stream from the headphone controller to each headphone 130A/130B. In some embodiments, headphones 130A and 130B may connect to headphone controller 140 via a wireless interface the interfaces 135A and 135B. For example, headphones 130A and 130B may connect to headphone controller 140 via a Wi-Fi (IEEE 802.11 family of standards), Bluetooth, Bluetooth Low Energy, or another suitable wireless digital interface.

The interface 150 between the headphone controller 140 and the electronic equipment 160 may include a digital interface and/or an analog signal interface. For example, a headphone controller may receive digitized audio and user volume and filtering commands via a digital interface such as a Universal Serial Bus (USB) interface, other digital interface, or wireless interface.

The electronic equipment 160 may include a computing device or a communication device, e.g., a smartphone, cell phone, audio or multimedia player device, gaming device, netbook, laptop computer, tablet computer, ultra-book computer, desktop computer, or other electronic equipment with an analog or digital interface. Electronic equipment 160 may include a user interface 170 to interface with a user on for controlling headphone operations, such as receiving user inputs regarding playback or live audio selection and filtering and/or amplitude selections by the user. Electronic equipment 160 may store audio data at 180. For example, digitized music may be stored in a non-volatile memory 180. Driver 190 may provide the interface between electronic equipment 160 and headphone controller 140.

Figure 2:
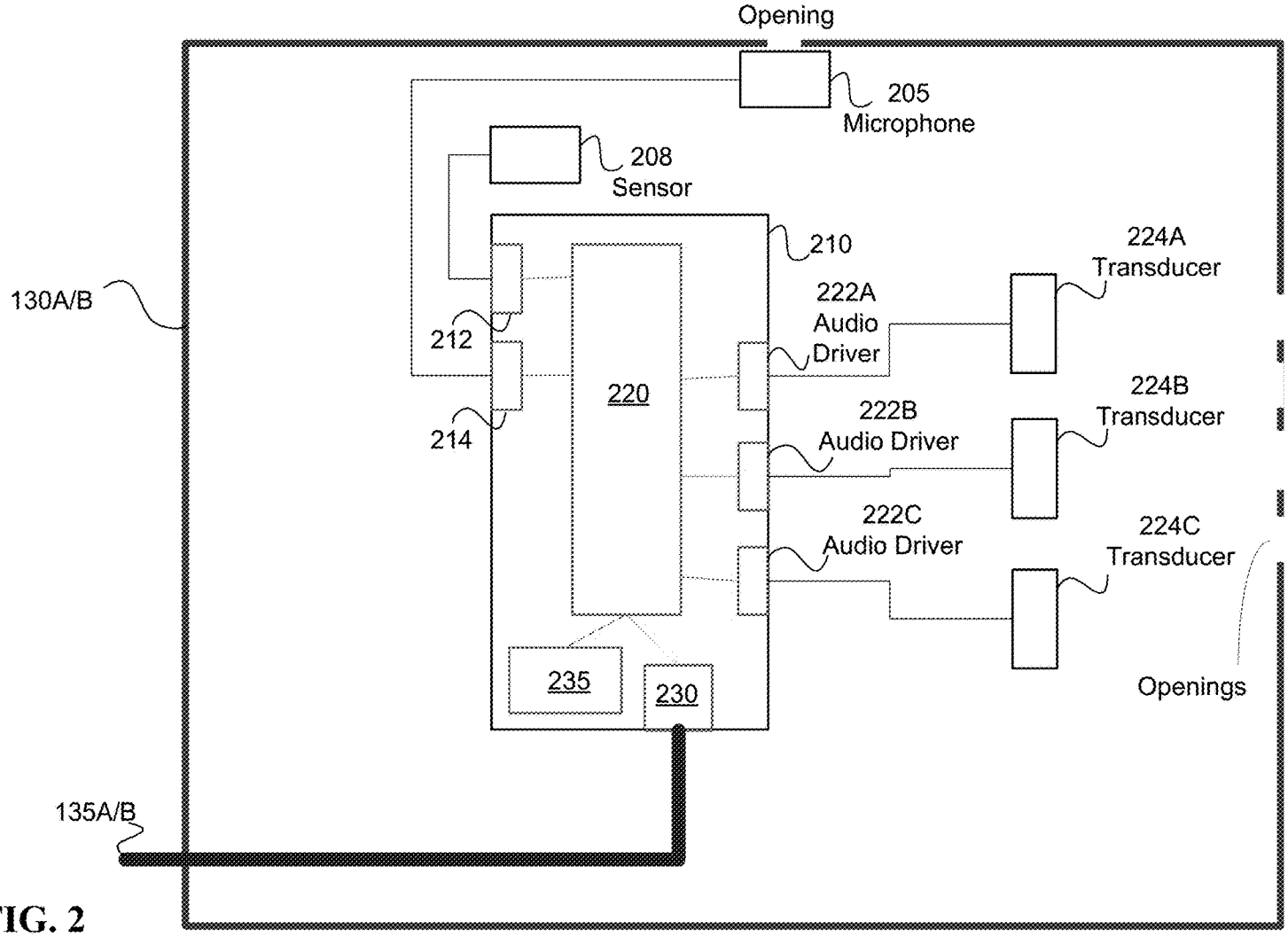
FIG. 2 depicts an example of a headphone apparatus for implementing the disclosed technology.

FIG. 2 depicts an example of a headphone for implementing the disclosed technology. The operations in connection with FIG. 2 are associated with operations referenced with respect to FIG. 1. A headphone such as headphone 130A/130B may include a headphone circuit 210, one or more microphones 205, sensor 208, and one or more transducers such as audio transducers 224A, 224B, and 224C. Headphone circuit 210 may interface to headphone controller 140 via interfaces 135A/135B.

Headphone circuit 210 may include a circuit board and one or more integrated circuits such as a microprocessor, digital signal processor (DSP), custom integrated circuit, or Application Specific Integrated Circuit (ASIC). For example, headphone circuit 210 may include a circuit board with integrated circuit (IC) 220 that is a microprocessor. Headphone circuit 210 may include and audio driver for each audio transducer. For example, in FIG. 2 three audio transducers 224A, 224B, and 224C have corresponding audio drivers 222A, 222B, and 222C that produce transducer driver signals to drive the transducers 224A, 224B and 224C based on the signals from the IC 220. In the following, one audio driver such as 222A and one audio transducer such as audio transducer 224A are described as a designated pair as an example. An audio driver such as audio driver 222A may include an digital-to-analog converter to transform digitized audio from integrated circuit 220 to an analog voltage to drive audio transducer 224A to generate desired sound. Audio driver 222A may also include amplification, impedance matching, voltage to current conversion, and other driver circuits. Headphone circuit 210 includes digital interface 230 to connect to the headphone controller 140 via interface 135A/135B. Digital interface 230 may include a serial digital interface, parallel digital interface, or combination serial-parallel interface. For example, digital interface 230 may include a two wire serial interface that may be connected via a two wire cable 135A/135B to headphone controller 140. In some example embodiments, digital interface 230 may be a wireless interface to headphone controller 140. For example, digital interface 230 may include a Bluetooth interface or other wireless interface. Headphone circuit 210 may include memory 235 for storing data in connection with the headphone operations. Memory 235 may include non-volatile memory, random access memory, or another suitable memory or combination of memories. Headphone circuit 210 may further include a microphone interface 214 that may include amplification and may also include an analog-to-digital converter to generate digitized audio from the sounds received by one or more microphones 205 that are exposed to receive sound or are located near openings of the headphone to receive sound. Headphone circuit 210 may also include interface 212 to connect to one or more sensors 208, e.g., a gravity sensor, gyroscope, accelerometer, biological sensor such as a heart rate sensor or other type of sensor. Interface 212 may be a digital interface, analog interface, or combination of analog and digital interfaces.

Integrated circuit 220 can be implemented as a microprocessor or an ASIC to condition or adjust the digital audio received at digital interface 230 from headphone controller 140 via interface 135A/135B. For example, the digitized audio may be adjusted by applying digital filters akin to a making adjustments via an audio equalizer. For example, user determined or predefined spectral masks may determine the gain/attenuation of individual frequencies across the audible frequency range. For example, a set of digital filters may adjust the gain/attenuation of the frequency range between 1 Hertz and 20 kilohertz in 10 Hertz steps. Other frequency ranges and step sizes may also be used. In some example embodiments, integrated circuit 220 may provide equalization of the digitized audio data to compensate for a non-uniform frequency response of an audio transducer. For example, headphone 130A/130B may calibrate the amplitude and frequency response of a transducer such as transducer 224A by driving transducer 224 at a single frequency that is swept across a predetermined range. Microphone 205 may detect the amplitude of sound generated by audio transducer 224A at a series of frequencies across the sweep. Based on the measured amplitude at each frequency, the response of the audio transducer can be determined. Using equalization, the audio transducer frequency response can be made uniform. For example, at frequencies where the amplitude is below an expected value, the gain can be increased for those frequencies to balance the less than expected amplitude.

A headphone such as headphone 130A or 130B may include one or more audio transducers. In the example of FIG. 2, headphone 130A includes three audio transducers 224A, 224B, and 224C that are exposed to output sound or are located near openings of headphone to output sound. The transducers 224A, 224B, and 224C may operate in different audio frequency ranges. For example one transducer may produce bass frequencies, one transducer may produce mid-range frequencies, and another transducer may produce high frequencies. Each headphone may include a microprocessor and/or digital signal processor to provide filtering or amplitude adjustment to the digital audio received from the headphone controller. For example, filtering may be based on user preferences such as adjusted treble, base, or mid-range, or effects such as three-dimensional effect, loudness, or saved or preset amplitude profiles across the audible spectrum (e.g. graphic equalizer settings). A headphone may include non-volatile memory, and sensor interfaces to an accelerometer, biological sensor, microphone or other sensor.

The digital interface between each headphone 130A or 130B and the headphone controller 140 may carry data from the headphone controller 140 to each headphone 130A or 130B including digitized audio data and may include command data for each headphone 130A or 130B. For example, a right side headphone may carry digitized audio for right side stereo audio and commands for the right side headphone. Commands to the right headphone may include a selected volume or amplitude, which acoustic transducers of the headphone to use, a filtering command, a bandwidth command for each transducer, and a center frequency, and/or a spectral mask for each transducer. A left side headphone may carry digitized audio for left side stereo audio and commands for the left side headphone. The foregoing types of commands for the right headphone may also be sent to the left headphone. The commands sent to the right and left headphones may be different to accommodate user preferences such as balance or other effects.

Figure 3:
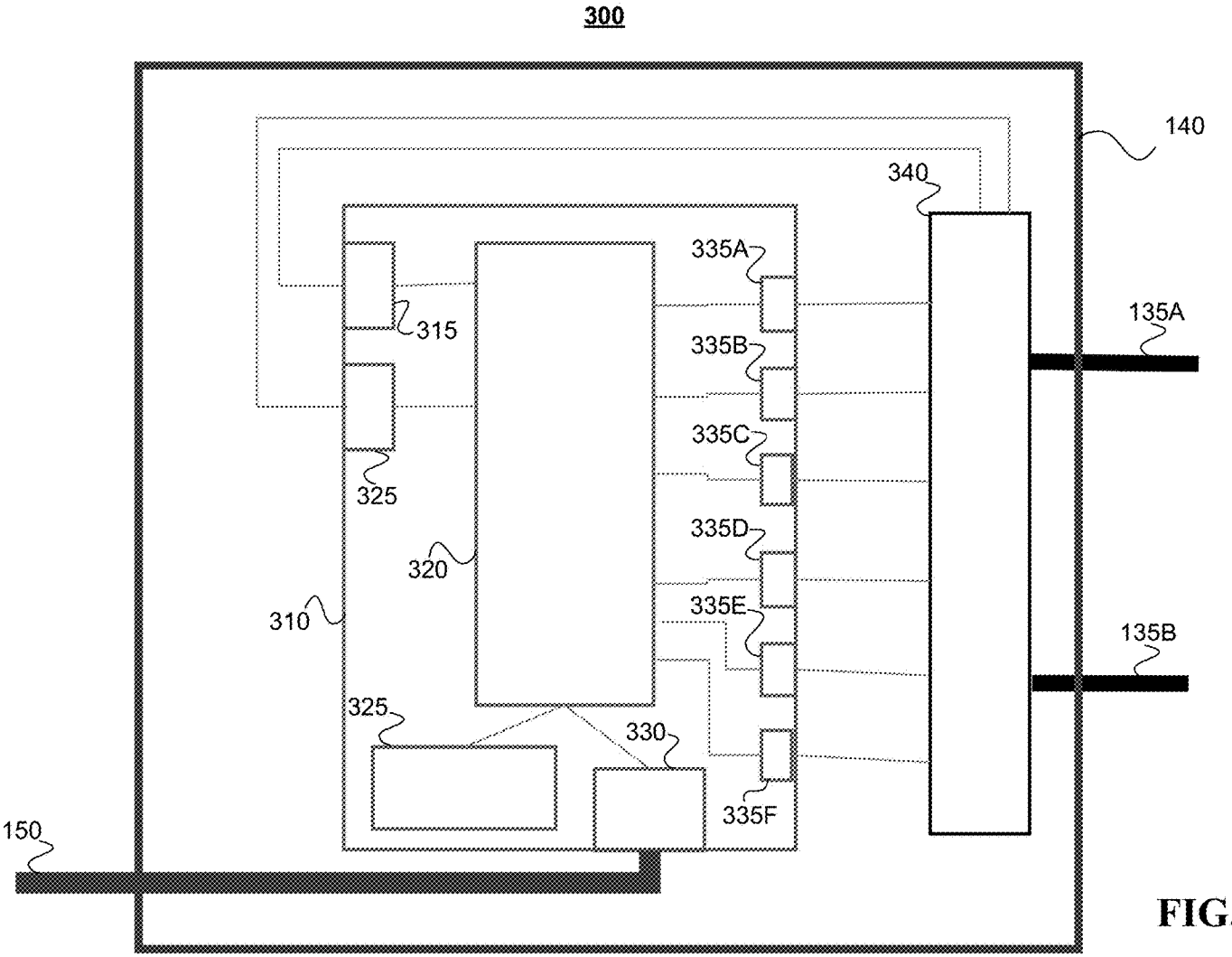
FIG. 3 depicts an example of a headphone controller for implementing the disclosed technology.

FIG. 3 depicts an example of a headphone controller 140. The operations in connection with FIG. 3 are associated with the operations referenced in FIGS. 1 and 2. Controller circuit 310 may include a circuit board and one or more integrated circuits such as a microprocessor, digital signal processor (DSP), custom integrated circuit, and/or ASIC. For example, controller circuit 310 may include a circuit board with integrated circuit 320 that is a microprocessor. Controller circuit 310 may include a microphone interface 325 as described above with respect to 214, sensor interface 315 as described with respect to 212, and/or memory 325 as described with respect to 235. In some example embodiments, headphone controller 140 is included in electronic equipment 160.

The communication interface 150 between the headphone controller 140 and the electronic equipment 160 may include a digital interface and/or an analog signal interface. For example, a headphone controller 140 may receive digitized audio and user volume and filtering commands via a digital interface 330. Interface 330 may include a digital interface such as a USB interface, other digital interface, or wireless interface such as Bluetooth or Wi-Fi or other wireless interface. The communication interface 150 may carry the digitized audio and user commands such as filtering and amplitude commands from electronic equipment 160 to headphone controller 140. In another example, headphone controller 140 may receive at interface 330 an analog voltage representative of audio to be played by headphones 130A and 130B. For example, a 3.5 mm coaxial connector may provide an analog voltage signal at electronic equipment 160. Commands such as amplitude and filtering commands may be passed from electronic equipment 160 to headphone controller 140 via a wireless interface such as Bluetooth or other wireless digital interface.

Headphone controller 140 includes interface circuit 340 to connect to wired or wireless interface(s) 135A/135B.

In some example embodiments integrated circuit 320 and integrated circuit 220 are the same integrated circuit. When 320 is the same integrated circuit as 220, three of six outputs from 335A-335F may be used. In some example embodiments audio drivers 222A-222C may be used as digital interfaces 335A-335C.

Figure 4:
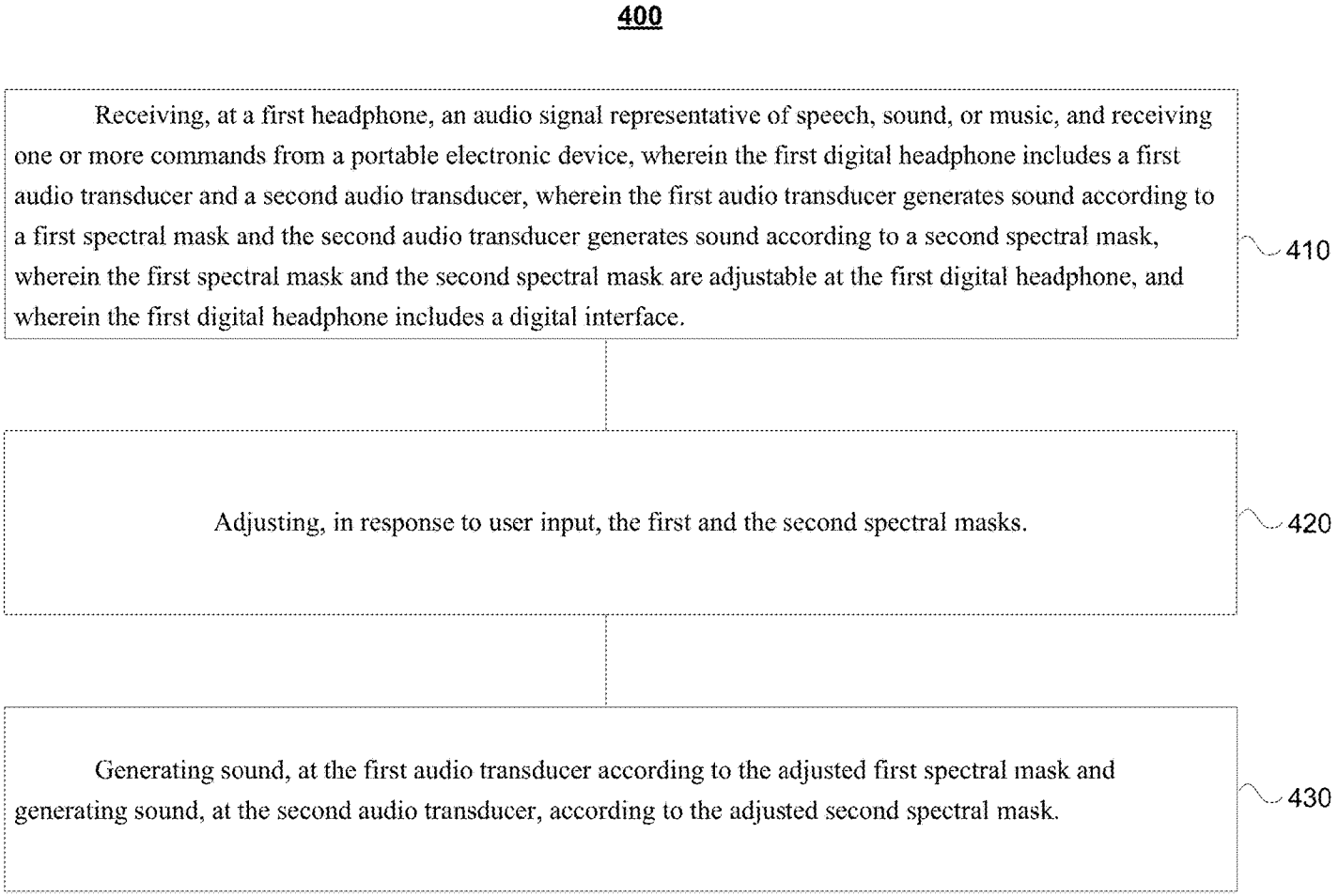
FIG. 4 depicts an example of a process for implementing the disclosed technology.

FIG. 4 depicts, an example of a process, in accordance with some example embodiments. FIG. 4 also refers to FIGS. 1-3. At 410, a first headphone receives an audio signal. The audio signal is transduced into sound by one or more audio transducers, each of which has a corresponding spectral mask. At 420, first and second spectral masks may be adjusted in response to a user input. At 430, the first audio transducer generates sound according to the adjusted first spectral mask and the second audio transducer generates sound according to the adjusted second spectral mask.

In some implementations, at 410 the audio signal received at the headphone such as headphone 130A may include speech, sound, or music, or other audio. For example, the first headphone may receive a digitized representation of music via interface 135A. In some example embodiments, the digital representation may be compressed according to a suitable audio compression standard such as MP3, MP4 or other standard. The first digital headphone may include one or more audio transducers. In the example of FIG. 2, three audio transducers are included in the first headphone 130A. In another example, two audio transducers may be included. A first audio transducer may generate sound according to a first spectral mask and a second audio transducer may generate audio according to a second spectral mask. The spectral masks may be adjusted according to user preferences and other factors. For example, a microphone such as microphone 205 may detect noise at the first headphone 130A. Headphone 130A may adjust the spectral mask according to a spectrum of noise detected at microphone 205. For example, headphone 130A may increase the amplitudes in the spectral mask for the transducers in the headphone corresponding to frequencies where noise is detected. The first digital headphone may include a digital interface such as a USB interface, wireless interface, or other wired or wireless interface to connect to the headphone controller 140 and/or electronic equipment 160. The first headphone may also receive one or more commands from a portable electronic device such as headphone controller 140 and/or electronic device 160. For example, headphone 130A may receive a command to adjust the spectral mask corresponding to one of more of the audio transducers in headphone 130A.

In some implementations of the operation at 420, the first and second spectral masks may be adjusted. For example, the first and second spectral masks may be adjusted in response to a user input. For example, a user at electronic device 160 may select to increase a sound amplitude at bass, mid-range or treble frequencies. Specifically, selection of increasing the bass sounds may cause one or more spectral masks corresponding to one or more audio transducers may be adjusted. For example, the bass frequency sound volume may be increased by increasing the amplitudes at the bass frequencies in the spectral mask corresponding to the audio transducer selected to produce the bass frequencies. In another example, the bass frequencies may be effectively increased by decreasing the amplitudes in the spectral masks for the audio transducers selected to produce mid-range and high frequency audio. In another example, the spectral masks may be adjusted and/or delays may be introduced into the sound produced at the first headphone relative to the sound produced at the second headphone to cause a three dimensional sound effect or surround sound effect.

In some implementations of the operation at 430, the first audio transducer may generate sound according to the adjusted first spectral mask and the second audio transducer may generate sound according to the adjusted second spectral mask.

Figure 5:
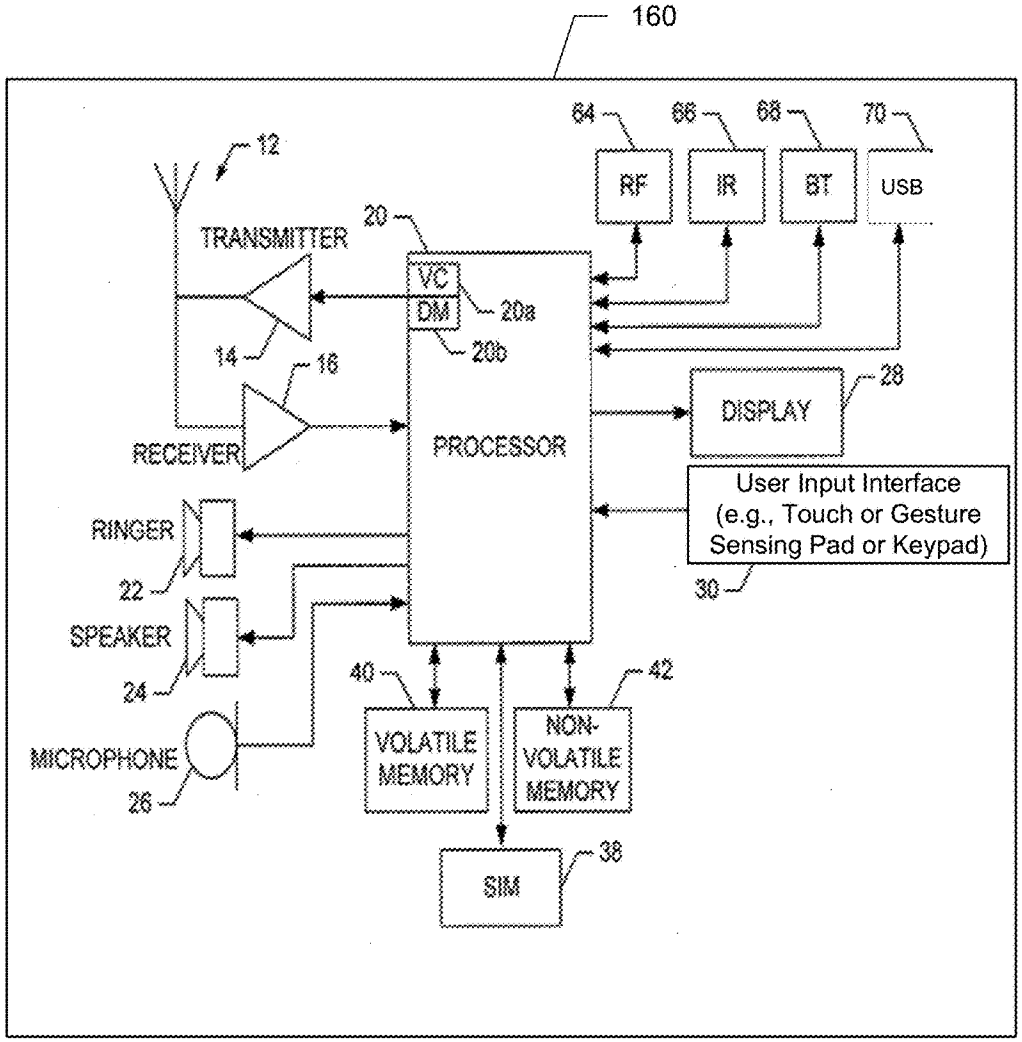
FIG. 5 depicts an example of an electronic player for implementing the disclosed technology.

FIG. 5 depicts an example of electronic equipment 160, in accordance with some example embodiments in connection with a mobile phone, smartphone, or a wireless device. Electronic equipment 160 may include a radio communication link to a cellular network, or other wireless network. The electronic equipment 160 may include at least one antenna 12 in communication with a transmitter 14 and a receiver 16. Alternatively transmit and receive antennas may be separate.

The electronic equipment 160 may also include a processor 20 configured to provide signals to and from the transmitter and receiver, respectively, and to control the functioning of the apparatus. Processor 20 may be configured to control the functioning of the transmitter and receiver by effecting control signaling via electrical leads to the transmitter and receiver. Likewise, processor 20 may be configured to control other elements of electronic equipment 160 by effecting control signaling via electrical leads connecting processor 20 to the other elements, such as a display or a memory. The processor 20 may, for example, be embodied in a variety of ways including circuitry, at least one processing core, one or more microprocessors with accompanying digital signal processor(s), one or more processor(s) without an accompanying digital signal processor, one or more coprocessors, one or more multi-core processors, one or more controllers, processing circuitry, one or more computers, various other processing elements including integrated circuits (for example, an ASIC, a field programmable gate array (FPGA), and/or the like), or some combination thereof. Electronic equipment 160 may include a location processor and/or an interface to obtain location information, such as positioning and/or navigation information. Accordingly, although illustrated in FIG. 5 as a single processor, in some example embodiments the processor 20 may comprise a plurality of processors or processing cores.

Signals sent and received by the processor 20 may include signaling information in accordance with an air interface standard of an applicable cellular system, and/or any number of different wireline or wireless networking techniques, comprising but not limited to Wi-Fi, wireless local access network (WLAN) techniques, such as, Institute of Electrical and Electronics Engineers (IEEE) 802.11, 802.16, and/or the like. In addition, these signals may include speech data, user generated data, user requested data, and/or the like.

The electronic equipment 160 may be capable of operating with one or more air interface standards, communication protocols, modulation types, access types, and/or the like. For example, the electronic equipment 160 and/or a cellular modem therein may be capable of operating based on one or more suitable wireless communication protocols or standards, e.g., first generation (1G) communication protocols, second generation (2G or 2.5G) communication protocols, third-generation (3G) communication protocols, fourth-generation (4G) communication protocols, fifth-generation (5G) communication protocols, Long Term Evolution (LTE), Internet Protocol Multimedia Subsystem (IMS) communication protocols (for example, session initiation protocol (SIP) and/or the like. For example, the electronic equipment 160 may be capable of operating in accordance with 2G wireless communication protocols IS-136, Time Division Multiple Access TDMA, Global System for Mobile communications, GSM, IS-95, Code Division Multiple Access, CDMA, and/or the like. In addition, for example, the electronic equipment 160 may be capable of operating in accordance with 2.5G wireless communication protocols General Packet Radio Service (GPRS), Enhanced Data GSM Environment (EDGE), and/or the like. Further, for example, the electronic equipment 160 may be capable of operating in accordance with 3G wireless communication protocols, such as, Universal Mobile Telecommunications System (UMTS), Code Division Multiple Access 2000 (CDMA2000), Wideband Code Division Multiple Access (WCDMA), Time Division-Synchronous Code Division Multiple Access (TD-SCDMA), and/or the like. The electronic equipment 160 may be additionally capable of operating in accordance with 3.9G wireless communication protocols, such as LTE, Evolved Universal Terrestrial Radio Access Network (E-UTRAN), and/or the like. Additionally, for example, the electronic equipment 160 may be capable of operating in accordance with 4G wireless communication protocols, such as LTE Advanced and/or the like as well as similar wireless communication protocols that may be subsequently developed.

It is understood that the processor 20 may include circuitry for implementing audio/video and logic functions of electronic equipment 160. For example, the processor 20 may comprise a digital signal processor device, a microprocessor device, an analog-to-digital converter, a digital-to-analog converter, and/or the like. Processor may generate or transfer digitized audio such as audio data 180 through a wireless interface such as 64, 66, 68, or 70, or through a wired interface such as USB interface control and signal processing functions of the electronic equipment 160 may be allocated between these devices according to their respective capabilities. The processor 20 may additionally comprise an internal voice coder (VC) 20*a*, an internal data modem (DM) 20*b*, and/or the like. Further, the processor 20 may include functionality to operate one or more software programs, which may be stored in memory. In general, processor 20 and stored software instructions may be configured to cause electronic equipment 160 to perform actions. For example, processor 20 may be capable of operating a connectivity program, such as, a web browser. The connectivity program may allow the electronic equipment 160 to transmit and receive web content, such as location-based content, according to a protocol, such as, wireless application protocol, WAP, hypertext transfer protocol, HTTP, and/or the like.

Electronic equipment 160 may also include a user interface including, for example, an earphone or speaker 24, a ringer 22, a microphone 26, a display 28, a user input interface, and/or the like, which may be operationally coupled to the processor 20. The display 28 may, as noted above, include a touch sensitive display, where a user may touch and/or gesture to make selections, enter values, and/or the like. The processor 20 may also include user interface circuitry configured to control at least some functions of one or more elements of the user interface, such as, the speaker 24, the ringer 22, the microphone 26, the display 28, and/or the like. The processor 20 and/or user interface circuitry comprising the processor 20 may be configured to control one or more functions of one or more elements of the user interface through computer program instructions, for example, software and/or firmware, stored on a memory accessible to the processor 20, for example, volatile memory 40, non-volatile memory 42, and/or the like. Electronic equipment 160 may generate user interface 170 via software, firmware, or other executable code. The electronic equipment 160 may include a portable power source such as a battery for powering various circuits related to the mobile terminal, for example, a circuit to provide mechanical vibration as a detectable output. The user input interface 30 may comprise devices allowing the electronic equipment 160 to receive user commands, instructions, or user data, such as, a touch sensing input, a gesture sensing input, a keypad 30 (which can be a virtual keyboard presented on display 28 or an externally coupled keyboard) and/or other input devices. Electronic equipment 160 may also include a user authentication mechanism based on a biomarker such as a fingerprint sensor for receiving a user fingerprint or other biomarker indicator. User voice input commands or instructions may also be provided by using the one or more microphones 26.

Moreover, the electronic equipment 160 may include a short-range radio frequency (RF) transceiver and/or interrogator 64, so data may be shared with and/or obtained from electronic devices in accordance with RF techniques. The electronic equipment 160 may include other short-range transceivers, such as an infrared (IR) transceiver 66, a Bluetooth (BT) transceiver 68 operating using Bluetooth wireless technology, a wireless USB transceiver 70, and/or the like. The Bluetooth transceiver 68 may be capable of operating according to low power or ultra-low power Bluetooth technology, for example, Wibree, radio standards. In this regard, the electronic equipment 160 and, in particular, the short-range transceiver may be capable of transmitting data to and/or receiving data from electronic devices within a proximity of the apparatus, such as within 10 meters. For example, electronic equipment may communicate wirelessly with headphone controller 140. The electronic equipment 160 including the Wi-Fi or wireless local area networking modem may also be capable of transmitting and/or receiving data from electronic devices according to various wireless networking techniques, including 6LoWpan, Wi-Fi, Wi-Fi low power, WLAN techniques such as IEEE 802.11 techniques, IEEE 802.15 techniques, IEEE 802.16 techniques, and/or the like.

The electronic equipment 160 may comprise memory, such as, a subscriber identity module (SIM) 38, a removable user identity module (R-UIM), and/or the like, which may store information elements related to a mobile subscriber. In addition to the SIM, the electronic equipment 160 may include other removable and/or fixed memory. The electronic equipment 160 may include volatile memory 40 and/or non-volatile memory 42. For example, volatile memory 40 may include Random Access Memory (RAM) including dynamic and/or static RAM, on-chip or off-chip cache memory, and/or the like. Non-volatile memory 42, which may be embedded and/or removable, may include, for example, read-only memory, flash memory, magnetic storage devices, for example, hard disks, floppy disk drives, magnetic tape, optical disc drives and/or media, non-volatile random access memory (NVRAM), and/or the like. Like volatile memory 40, non-volatile memory 42 may include a cache area for temporary storage of data. At least part of the volatile and/or non-volatile memory may be embedded in processor 20. The memories may store one or more software programs, instructions, pieces of information, data, and/or the like which may be used by the apparatus for performing functions of the user equipment/mobile terminal. The memories may comprise an identifier, such as an international mobile equipment identification (IMEI) code, capable of uniquely identifying electronic equipment 160. The functions may include one or more of the operations disclosed herein including the process flow of FIG. 4, and the like. The memories may comprise an identifier, such as, an international mobile equipment identification (IMEI) code, capable of uniquely identifying electronic equipment 160. In the example embodiment, the processor 20 may be configured using computer code stored at memory 40 and/or 42 to provide the operations disclosed with respect to the processes described with respect to FIG. 4, and the like.

Some of the embodiments disclosed herein may be implemented in software, hardware, application logic, or a combination of software, hardware, and application logic. The software, application logic, and/or hardware may reside in memory 40, the processor 20, or electronic components disclosed herein, for example. In some example embodiments, the application logic, software or an instruction set is maintained on any one of various conventional computer-readable media. In the context of this document, a "computer-readable medium" may be any non-transitory media that can contain, store, communicate, propagate or transport the instructions for use by or in connection with an instruction execution system, apparatus, or device, such as a computer or data processor circuitry. A computer-readable medium may comprise a non-transitory computer-readable storage medium that may be any media that can contain or store the instructions for use by or in connection with an instruction execution system, apparatus, or device, such as a computer. Furthermore, some of the embodiments disclosed herein include computer programs configured to cause methods as disclosed herein (see, for example, the process 400).

The subject matter described herein may be embodied in systems, apparatus, methods, and/or articles depending on the desired configuration. For example, the systems, apparatus, methods, and/or articles described herein can be implemented using one or more of the following: electronic components such as transistors, inductors, capacitors, resistors, and the like, a processor executing program code, an application-specific integrated circuit (ASIC), a digital signal processor (DSP), an embedded processor, a field programmable gate array (FPGA), and/or combinations thereof. These various example embodiments may include implementations in one or more computer programs that are executable and/or interpretable on a programmable system including at least one programmable processor, which may be special or general purpose, coupled to receive data and instructions from, and to transmit data and instructions to, a storage system, at least one input device, and at least one output device. These computer programs (also known as programs, software, software applications, applications, components, program code, or code) include machine instructions for a programmable processor, and may be implemented in a high-level procedural and/or object-oriented programming language, and/or in assembly/machine language. As used herein, the term "machine-readable medium" refers to any computer program product, computer-readable medium, computer-readable storage medium, apparatus and/or device (for example, magnetic discs, optical disks, memory, Programmable Logic Devices (PLDs)) used to provide machine instructions and/or data to a programmable processor, including a machine-readable medium that receives machine instructions. Similarly, systems are also described herein that may include a processor and a memory coupled to the processor. The memory may include one or more programs that cause the processor to perform one or more of the operations described herein.

Although a few variations have been described in detail above, other modifications or additions are possible. In particular, further features and/or variations may be provided in addition to those set forth herein. Moreover, the example embodiments described above may be directed to various combinations and subcombinations of the disclosed features and/or combinations and subcombinations of several further features disclosed above. In addition, the logic flow depicted in the accompanying figures and/or described herein does not require the particular order shown, or sequential order, to achieve desirable results. Other embodiments may be within the scope of the following claims.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described and other implementations, enhancements and variations can be made based on what is described and illustrated in this patent document.

What is claimed is:

1. A headphone apparatus comprising:

a first headphone including a first audio transducer and a second audio transducer, wherein the first audio transducer generates sound according to a first spectral mask and the second audio transducer generates sound according to a second spectral mask, wherein the first spectral mask and the second spectral mask are adjustable at the first headphone, and wherein the first headphone includes a digital interface that receives first audio information and first audio reproduction control information;

a second headphone including a third audio transducer and a fourth audio transducer, wherein the third audio transducer generates sound according to a third spectral mask and the fourth audio transducer generates sound according to a fourth spectral mask, wherein the third spectral mask and the fourth spectral mask are adjustable at the second headphone, and wherein the second headphone includes the digital interface to receive second audio information and second audio reproduction control information; and a headphone controller to control the first headphone and the second headphone, wherein the headphone controller receives an audio signal from a portable electronic device, wherein the headphone controller transmits digital information including the first audio information and the first audio reproduction control information to the first headphone, and transmits the second audio information and the second audio reproduction control information to the second headphone, wherein the headphone controller, in response to a user input, generates the first audio reproduction control information and the second audio reproduction control information that causes an adjustment to one or more of the first spectral mask or the second spectral mask by applying at least one first digital filter and causes an adjustment to one or more of the third spectral mask or the fourth spectral mask by applying at least one second digital filter.

2. The headphone apparatus according to claim 1, wherein the first headphone further includes:

a fifth audio transducer, wherein the fifth audio transducer generates sound according to a fifth spectral mask, wherein the first spectral mask corresponds to bass frequencies, the second spectral mask corresponds to mid-range frequencies, and the fifth spectral mask corresponds to high frequencies.

3. The headphone apparatus according to claim 1, wherein the audio signal is represented by parallel digital data stream or a serial digital data stream.

4. The headphone apparatus according to claim 1, wherein the audio signal includes an analog voltage signal.

5. The headphone apparatus according to claim 1, wherein the portable electronic device includes a smartphone, cell phone, tablet, or wearable electronic device.

6. The headphone apparatus according to claim 1, wherein one or more of the first spectral mask and the second spectral mask are adjusted to cause a three-dimensional sound effect.

7. The headphone apparatus according to claim 6, wherein one or more timing delays are added to the digital information to generate the three-dimensional sound effect.

8. The headphone apparatus according to claim 1, wherein the headphone apparatus includes one or more interfaces to receive information from one or more of an accelerometer, a microphone, a gyroscope, a biological sensor, a head position sensor, or a heart rate sensor.

9. A method for generating sound comprising:

transmitting, from a controller to a first headphone, a first audio signal that includes speech, sound, or music, wherein the first headphone includes an audio transducer to produce adjustable sound characteristics at the first headphone;

transmitting, from the controller to a second headphone, a second audio signal that includes the speech, sound, or music, wherein the second headphone includes another audio transducer to produce adjustable sound characteristics at the second headphone;

receiving, via a digital interface from a user device, a user command that specifies a desired sound reproduction profile specified by a user; and adjusting, in response to the received user command, an operation of the at least one of the audio transducer or the other audio transducer to adjust sound characteristics at the first headphone or the second headphone, the adjusting including applying a digital filter to change at least one of the first audio signal or the second audio signal based on the desired sound reproduction profile specified by the user.

10. The method for generating sound according to claim 9, wherein the desired sound reproduction profile includes an adjustment in a frequency range in a bass frequency range, a mid-frequency range or a high-frequency range.

11. The method for generating sound according to claim 9, wherein the audio signal is represented by parallel digital data stream or a serial digital data stream.

12. The method for generating sound according to claim 9, wherein the audio signal is an analog voltage signal.

13. The method for generating sound according to claim 9, wherein the user device includes a portable electronic device.

14. The method for generating sound according to claim 9, wherein the desired sound reproduction profile specified by the user to cause a three-dimensional sound effect.

15. The method for generating sound according to claim 14, wherein one or more timing delays are added to the first or second audio signals to generate the three-dimensional sound effect.

16. The method for generating sound according to claim 9, wherein the controller includes one or more interfaces to receive information from one or more of an accelerometer, a microphone, a gyroscope, a biological sensor, a head position sensor, or a heart rate sensor.

* * * * *